US012478232B2

(12) United States Patent
Song et al.

(10) Patent No.: US 12,478,232 B2
(45) Date of Patent: Nov. 25, 2025

(54) ROBOT CLEANER

(71) Applicant: LG ELECTRONICS INC., Seoul (KR)

(72) Inventors: Hyunsup Song, Seoul (KR); Sangik Lee, Seoul (KR); Seungjin Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 403 days.

(21) Appl. No.: 18/018,681

(22) PCT Filed: Oct. 5, 2020

(86) PCT No.: PCT/KR2020/013461
§ 371 (c)(1),
(2) Date: Jan. 30, 2023

(87) PCT Pub. No.: WO2022/030680
PCT Pub. Date: Feb. 10, 2022

(65) Prior Publication Data

US 2023/0301476 A1 Sep. 28, 2023

(30) Foreign Application Priority Data

Aug. 6, 2020 (KR) ..... 10-2020-0098357

(51) Int. Cl.
*A47L 9/00* (2006.01)
*A47L 9/28* (2006.01)

(52) U.S. Cl.
CPC ..... *A47L 9/009* (2013.01); *A47L 9/2805* (2013.01); *A47L 9/2852* (2013.01); *A47L 2201/00* (2013.01)

(58) Field of Classification Search
CPC ..... A47L 9/2852; A47L 9/009; A47L 9/2805; A47L 2201/00
See application file for complete search history.

(56) References Cited

U.S. PATENT DOCUMENTS 12,004,706 B2 * 6/2024 Liggett ..... A47L 9/009
2012/0181099 A1 * 7/2012 Moon ..... A47L 9/009 901/1

(Continued)

FOREIGN PATENT DOCUMENTS

CN 109419453 A 3/2019
KR 10-2011-0133902 A 12/2011

(Continued)

OTHER PUBLICATIONS

KR-20180068622-A—English Machine Translation (Year: 2018).*

*Primary Examiner* — Marc Carlson
(74) *Attorney, Agent, or Firm* — Birch, Stewart, Kolasch & Birch, LLP

(57) ABSTRACT

The present invention relates to a robot cleaner and, more particularly, to a robot cleaner comprising: a main body forming the outer appearance; a suction unit provided in the main body; a dust collecting unit which is provided in the main body and collects dust introduced through the suction unit; a driving motor which provides rotating power to move the main body, and includes a driving shaft and a driving gear coupled to one end portion of the driving shaft; a driving wheel rotating according to driving of the driving motor; a deceleration gear unit which connects the driving motor to the driving wheel and transmits the rotating power generated by the driving motor to the driving wheel; a first housing which is coupled to the driving motor and covers at least a part of the driving wheel; and a second housing which is provided between the driving wheel and the first housing to be respectively coupled to the driving wheel and the first housing, and has a wheel accommodation unit provided at one side thereof for accommodating the driving wheel, and a gear accommodation unit provided at the other side for accommodating the deceleration gear unit. The first housing may be fixed by being coupled to the driving motor, and the (Continued)

second housing and the driving wheel coupled to the second housing may be provided to pivotably rotate together by using, as a rotary shaft, a gear shaft of a deceleration gear included in the deceleration gear unit.

20 Claims, 10 Drawing Sheets

(56) References Cited

U.S. PATENT DOCUMENTS

| | | | | |
|---|---|---|---|---|
| 2013/0081218 | A1* | 4/2013 | Kim | A47L 9/009 15/21.1 |
| 2016/0081525 | A1* | 3/2016 | Kim | B60B 15/263 15/340.1 |
| 2016/0297276 | A1* | 10/2016 | Jeong | B60G 17/0195 |
| 2017/0036537 | A1* | 2/2017 | Yan | B60B 3/082 |

FOREIGN PATENT DOCUMENTS

| | | | | |
|---|---|---|---|---|
| KR | 20110133902 | A | * | 12/2011 |
| KR | 10-2012-0082813 | A | | 7/2012 |
| KR | 10-2016-0107663 | A | | 9/2016 |
| KR | 20160138812 | A | * | 12/2016 |
| KR | 101778542 | B1 | * | 9/2017 |
| KR | 10-2018-0068622 | A | | 6/2018 |
| KR | 20180068622 | A | * | 6/2018 |

* cited by examiner (a)

(b)

(a)

(b)

ROBOT CLEANER

CROSS REFERENCE TO RELATED APPLICATIONS

This application is the National Phase of PCT International Application No. PCT/KR2020/013461, filed on Oct. 5, 2020, which claims priority under 35 U.S.C. 119 (a) to Patent Application No. 10-2020-0098357, filed in the Republic of Korea on Aug. 6, 2020, all of which are hereby expressly incorporated by reference into the present application.

TECHNICAL FIELD

The present disclosure relates to a robot cleaner. More specifically, the present disclosure relates to a robot cleaner including a movable driving wheel.

BACKGROUND

In general, a robot cleaner is a cleaning device that travels by itself within a certain range of a working area without manipulation of a user and sucks in dust, foreign substances, and the like from a travel surface, and performs a cleaning work by determining a location of an obstacle or a wall via a sensor, a camera, or the like, and traveling while avoiding the obstacle or the wall using the determination information.

The robot cleaner includes a driving wheel constructed to move on the travel surface by receiving power from a driving motor, and the driving wheel is constructed to be movable within a specific range. For example, when the robot cleaner moves on a travel surface with the obstacle such as a carpet or a threshold, the driving wheel may be constructed to move upwards. Accordingly, the robot cleaner may easily avoid the obstacle and travel. Alternatively, when the robot cleaner moves on a travel surface with a concave pit, the driving wheel may be constructed to move downwards. Accordingly, the robot cleaner may easily avoid the pit and travel. That is, as the driving wheel is constructed to move upwards and downwards, the robot cleaner may perform the cleaning work by moving smoothly not only when the travel surface is a flat surface but also when the travel surface is an uneven surface.

In the conventional robot cleaner, a pivoting shaft for pivoting of the driving wheel is separately disposed, so that the driving wheel moves upwards and downwards. In general, the pivoting shaft is located under the driving motor connected to the driving wheel. In the case of the conventional robot cleaner, when the driving wheel pivots, the driving motor adjacent to the pivoting shaft and wires connected to the driving motor also pivot together. Accordingly, disconnection of the wires may occur.

In this regard, Korean Patent Application Publication No. 10-2012-0082813 (hereinafter, referred to as prior art) discloses a robot cleaner in which the driving wheel moves upwards and downwards. In this regard, the pivoting shaft of the driving wheel and a driving rotation shaft of the driving motor are arranged on a coaxial line. According to the prior art, because the driving motor is fixed when the driving wheel pivots, the disconnection of the wires connected to the driving motor may be prevented.

However, according to the prior art, a vertical level of a central shaft of the driving wheel is relatively lower than a vertical level of the driving rotation shaft of the driving motor serving as the pivoting shaft of the driving wheel. Therefore, the robot cleaner according to the prior art has disadvantages that a vertical reaction force of the driving wheel is reduced compared to that of the conventional robot cleaner, and accordingly, suspension of the driving wheel is not effectively performed. In addition, according to the prior art, a distance between the central shaft of the driving wheel and the pivoting shaft of the driving wheel is increased compared to that of the conventional robot cleaner, so that a space required for the suspension of the driving wheel is increased.

SUMMARY

Technical Problem

One of various tasks of the present disclosure is to provide a robot cleaner in which suspension of a driving wheel may be effectively performed while maintaining a fixed state of a driving motor.

Technical Solutions

A robot cleaner according to embodiments of the present disclosure includes a main body for forming an outer appearance of the robot cleaner, cleaning means disposed in the main body so as to perform a cleaning work, a driving motor for providing a rotational force so as to move the main body and including a driving shaft and a driving gear coupled to one end of the driving shaft, a driving wheel rotating by driving the driving motor, and a reduction gear assembly for connecting the driving motor and the driving wheel to each other and transmitting the rotational force generated from the driving motor to the driving wheel, and the driving wheel is constructed to pivot using a gear shaft of a reduction gear included in the reduction gear assembly as a pivoting shaft. The gear shaft serving as the pivoting shaft of the driving wheel is not disposed coaxially with the driving shaft of the driving motor.

A robot cleaner according to embodiments of the present disclosure includes a main body for forming an outer appearance of the robot cleaner, suction means (suction portion) disposed in the main body, dust collecting means (dust collecting portion) disposed in the main body so as to collect dust introduced via the suction means, a driving motor for providing a rotational force so as to move the main body and including a driving shaft and a driving gear coupled to one end of the driving shaft, a driving wheel rotating by driving the driving motor, a reduction gear assembly for connecting the driving motor and the driving wheel to each other and transmitting the rotational force generated from the driving motor to the driving wheel, a first housing coupled to the driving motor and covering at least a portion of the driving wheel, and a second housing disposed between the driving wheel and the first housing and coupled to the driving wheel and the first housing, wherein the second housing has a wheel accommodating portion for accommodating therein the driving wheel at one side thereof, and a gear accommodating portion for accommodating therein the reduction gear assembly at the other side thereof. The first housing is fixed by the coupling with the driving motor, and the second housing and the driving wheel coupled thereto are constructed to pivot together using a gear shaft of a reduction gear included in the reduction gear assembly as a pivoting shaft.

The reduction gear assembly may include a plurality of reduction gears disposed in the gear accommodating portion so as to be engaged with each other and a plurality of gear shafts extending through respective central portions of the plurality of reduction gears, the plurality of reduction gears may be coupled to the gear accommodating portion by the plurality of gear shafts, respectively, the second housing may be coupled to the first housing so as to pivot using one of the plurality of gear shafts as the pivoting shaft, and the driving wheel may be constructed to pivot together with the second housing using one of the plurality of gear shafts as a pivoting shaft.

The second housing may be coupled to the first housing so as to pivot using a gear shaft of a reduction gear located closest to the driving motor among the plurality of reduction gears as the pivoting shaft, and the driving wheel may be constructed to pivot together with the second housing using the gear shaft of the reduction gear located closest to the driving motor as the pivoting shaft.

The reduction gear assembly may include a first reduction gear constructed to be engaged with the driving gear, a second reduction gear constructed to be engaged with the first reduction gear, and a third reduction gear constructed to be engaged with the second reduction gear, and the driving wheel may be constructed to pivot together with the second housing using a gear shaft of the first reduction gear as the pivoting shaft.

The reduction gear assembly may further include a first gear shaft extending through a central portion of the first reduction gear, a second gear shaft extending through a central portion of the second reduction gear, and a third gear shaft extending through a central portion of the third reduction gear, and the driving wheel may be constructed to pivot together with the second housing using the first gear shaft as the pivoting shaft.

The first gear shaft serving as the pivoting shaft of the driving wheel may not be disposed coaxially with the driving shaft.

The gear accommodating portion may include a first partition wall protruding from the wheel accommodating portion and a first disposition surface partitioned by the first partition wall such that the reduction gear assembly is disposed thereon, and the first partition wall and the first disposition surface may respectively have extensions extending toward the driving motor more than the wheel accommodating portion and partially overlapping the first housing.

The extension of the first partition wall may extend along a circumferential direction of a circle centered on the first gear shaft.

The extension of the first partition wall may include an upper portion disposed at a higher location than the first gear shaft in a state before the second housing pivots, and a lower portion disposed at a lower location than the first gear shaft in the state before the second housing pivots, and the upper portion of the first partition wall extension and the lower portion of the first partition wall extension may be formed to be spaced apart from each other, and the driving gear may be disposed therebetween.

The first housing may include a second housing coupled portion partially overlapping the extension of the first partition wall and the extension of the first disposition surface, the second housing coupled portion may include a second partition wall protruding in the same direction as a protruding direction of the first partition wall from the first housing, and a second disposition surface partitioned by the second partition wall such that the extension of the first disposition surface is disposed thereon, and the extension of the first disposition surface and the second disposition surface may be coupled to each other as the first gear shaft sequentially extends therethrough.

An area of the second disposition surface may be smaller than an area of the first disposition surface extension.

The second partition wall may continuously extend so as to cover the upper portion of the first partition wall extension and the lower portion of the first partition wall extension together, and, in a space surrounded by the second partition wall, the upper portion of the first partition wall extension, the lower portion of the first partition wall extension, and the extension of the first disposition surface, a driving gear movement portion where the driving gear slides when the second housing pivots may be defined.

The driving gear movement portion may extend along the circumferential direction of the circle centered on the first gear shaft by an angle equal to or greater than a pivoting angle of the second housing, and the driving gear may be disposed at a different location within the driving gear movement portion when the second housing pivots.

The driving gear may be disposed adjacent to the upper portion of the first partition wall extension than to the lower portion of the first partition wall extension within the driving gear movement portion in the state before the second housing pivots, and, in a state after the second housing pivots, the driving gear may be disposed adjacent to the lower portion of the first partition wall extension than to the upper portion of the first partition wall extension within the driving gear movement portion.

The reduction gear assembly may further include a wheel gear coupled to the driving wheel and a wheel gear shaft extending through a central portion of the wheel gear, and the wheel gear and the wheel gear shaft may extend through the gear accommodating portion together and may be coupled to a central portion of the driving wheel.

The gear accommodating portion may further include a first reduction gear cover for covering the reduction gear assembly so as not to be exposed to the outside, and a first gear shaft may extend through the first reduction gear cover and the first reduction gear cover may be constructed to pivot using the first gear shaft as a pivoting shaft.

The first housing may further include a second reduction gear cover for covering the first gear shaft and a portion of the first reduction gear cover adjacent to the first gear shaft so as not to be exposed to the outside.

The robot cleaner may further include a suspension for connecting the first housing and the second housing to each other and allowing the pivoting of the second housing to be elastically performed.

The suspension may include a first suspension coupling portion and a second suspension coupling portion disposed on the first housing, and an elastic member (elastic portion) coupled to the first suspension coupling portion and the second suspension coupling portion.

A robot cleaner according to embodiments of the present disclosure includes a driving motor disposed in a main body and including a driving shaft and a driving gear coupled to one end of the driving shaft, a driving wheel rotating by driving the driving motor, a reduction gear assembly for connecting the driving motor and the driving wheel to each other and transmitting a rotational force generated from the driving motor to the driving wheel, a first housing coupled to the driving motor and covering at least a portion of the driving wheel, and a second housing disposed between the driving wheel and the first housing and coupled to the driving wheel and the first housing, wherein the second housing has a wheel accommodating portion for accommodating therein the driving wheel at one side thereof, and a gear accommodating portion for accommodating therein the reduction gear assembly at the other side thereof. The first housing is fixed by the coupling with the driving motor, and the second housing and the driving wheel coupled thereto are constructed to pivot together using a gear shaft of a reduction gear located second closest to the driving motor among reduction gears included in the reduction gear assembly as a pivoting shaft.

Advantageous Effects

According to the robot cleaner according to the embodiments of the present disclosure, when the driving wheel pivots, the driving motor connected to the driving wheel via the plurality of reduction gears may be fixed so as not to pivot together, and accordingly, the disconnection of the wires connected to the driving motor may be prevented.

In this regard, the driving wheel may pivot using the gear shaft of the reduction gear located closest to the driving motor among the plurality of reduction gears as the pivoting shaft. In this case, compared to a case in which the driving wheel pivots using the driving shaft of the driving motor as the pivoting shaft, a vertical level of a central shaft of the driving wheel may be relatively high and a vertical reaction force of the driving wheel may increase, and thus the suspension of the driving wheel may be effectively performed.

In addition, when the driving wheel pivots using the gear shaft of the reduction gear located closest to the driving motor as the pivoting shaft, compared to the case in which the driving wheel pivots using the driving shaft of the driving motor as the pivoting shaft, a distance between the central shaft of the driving wheel and the pivoting shaft of the driving wheel may decrease, and accordingly, a space required for the suspension of the driving wheel may decrease.

DETAILED DESCRIPTION

Hereinafter, a specific embodiment of the present disclosure will be described with reference to the drawings. Following detailed description is provided to provide a comprehensive understanding of a method, an apparatus, and/or a system described herein. However, this is merely an example and the present disclosure is not limited thereto.

In describing embodiments of the present disclosure, when it is determined that a detailed description of a known technology related to the present disclosure may unnecessarily obscure the gist of the present disclosure, the detailed description will be omitted. In addition, terms to be described later, as terms defined in consideration of functions thereof in the present disclosure, may vary based on intentions of users and operators or customs. Therefore, the definition thereof should be made based on the content throughout this specification. Terms used in the detailed description are for illustrating the embodiments of the present disclosure only, and should not be restrictive. Unless explicitly used otherwise, the singular expression includes the plural expression. Herein, expressions such as "comprising" or "including" are intended to indicate certain features, numbers, steps, operations, elements, and some or combinations thereof, and should not be construed to exclude a presence or a possibility of one or more other features, numbers, steps, operations, elements, or some or combinations thereof other than those described.

In addition, in describing components of an embodiment of the present disclosure, terms such as first, second, A, B, (a), (b), and the like may be used. These terms are only for distinguishing the components from other components, and an essence, an order, or a sequence of the corresponding components are not limited by the terms.

Figure 1:
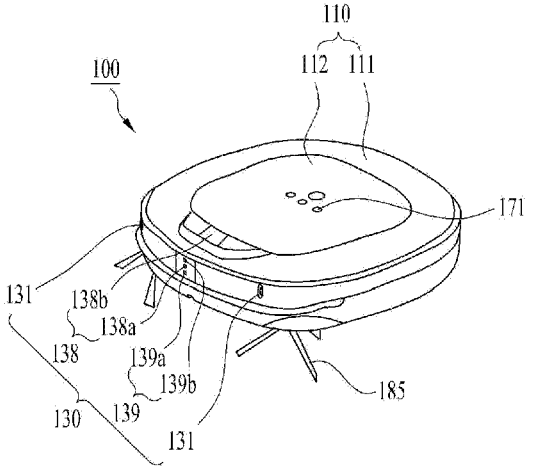
FIG. 1 is a diagram for illustrating a robot cleaner according to one embodiment of the present disclosure.
Figure 1:
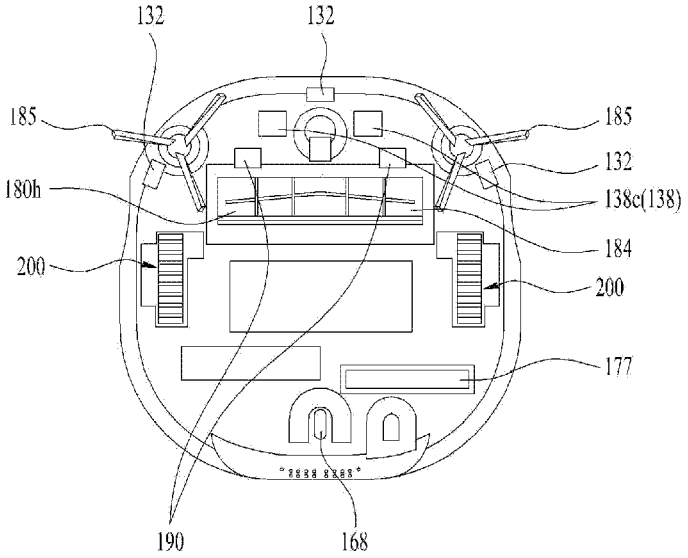

FIG. 1 is a diagram for illustrating a robot cleaner according to one embodiment of the present disclosure. More specifically, (a) in FIG. 1 is a perspective view for illustrating an overall outer appearance of the robot cleaner, (b) in FIG. 1 is a bottom view for illustrating a bottom structure of the robot cleaner.

Referring to (a) and (b) in FIG. 1, a robot cleaner 100 may include a main body 110. Hereinafter, in defining each portion of the main body 110, a portion facing a ceiling in a travel section is defined as a top surface, a portion facing a floor in the travel section is defined as a bottom surface, and a portion directed in a travel direction among portions forming a circumference of the main body 110 between the top surface and the bottom surface is defined as a front surface. In addition, a portion directed in a direction opposite to the front surface of the main body 110 is defined as a rear surface. The main body 110 may include a casing 111 for defining therein a space in which various parts constituting the robot cleaner 100 are accommodated.

The robot cleaner 100 may include sensing means 130 that performs sensing to acquire current state information. The sensing means 130 may sense a surrounding situation of the robot cleaner 100 during travel of the robot cleaner 100, and the sensing means 130 may also sense a state of the robot cleaner 100.

The sensing means 130 may sense information on the travel section. The sensing means 130 may sense an obstacle, such as a wall, furniture, a cliff, and the like on a travel surface, and a charging device for a robot cleaner for charging the robot cleaner 100. The sensing means 130 may sense information on the ceiling. The robot cleaner 100 may map the travel section via the information sensed by the sensing means 130.

The sensing means 130 may include at least one of a distance detection sensor 131, a cliff detection sensor 132, an external signal detection sensor (not shown), an impact detection sensor (not shown), an image detection sensor 138, 3D sensors 138*a*, 139*a*, and 139*b*, and a sensor for detecting whether docking is performed. The sensing means 130 may further include a docking detection sensor (not shown) that senses whether the docking with respect to the charging device for the robot cleaner is successful.

The robot cleaner 100 may include a battery 177 for supplying driving power to each component. The battery 177 may be mounted in the main body 110 and may supply power for the robot cleaner 100 to perform an action based on selected action information. The battery 177 may be detachably disposed in the main body 110.

The battery 177 may be charged as the robot cleaner 100 is docked and connected to the charging device for the robot cleaner. When an amount of charge of the battery 177 is equal to or lower than a predetermined value, the robot cleaner 100 may start a docking mode for the charging. In the docking mode, the robot cleaner 100 may travel back to the charging device for the robot cleaner.

The robot cleaner 100 may include travel means 200 that moves the main body 110 on the floor. The travel means 200 may include at least one driving wheel for moving the main body 110 and a driving motor for driving the at least one driving wheel. (b) in FIG. 1 simply shows only an outer appearance of the travel means 200 viewed from below, and a detailed description of the travel means 200 will be made later with reference to FIGS. 2 to 4.

In example embodiments, the driving wheel may include a left wheel and a right wheel respectively disposed at left and right sides of the main body 110. The left wheel and the right wheel may be driven by a single driving motor, but a left wheel driving motor driving the left wheel and a right wheel driving motor driving the right wheel may be separately disposed when necessary. The travel direction of the main body 110 may be switched to the left or right by making a difference between rotation speeds of the left wheel and the right wheel. In one embodiment, the travel means 200 may further include an auxiliary wheel 168 that does not provide a separate driving force, but assists the main body with respect to the floor.

The robot cleaner 100 may include working means that performs a predetermined work, and the robot cleaner 100 may clean the floor by the working means while moving in the travel section. The working means may perform suction of foreign substances and may perform mopping.

The working means may include suction means for sucking the foreign substances, brushes 184 and 185 for performing sweeping, dust collecting means (not shown) for collecting dust or the foreign substances collected by the suction means or the brushes, and/or a mop (not shown) for performing the mopping.

The suction means may include a suction hole **180*h* defined in a bottom surface of the main body 110 and through which air is sucked. A suction device (not shown) for providing a suction force such that the air is sucked via the suction hole 180*h* may be disposed in the main body 110**.

The dust collecting means may be disposed inside the main body 110 so as to collect the dust sucked together with the air via the suction hole **180*h***.

An opening for insertion and removal of a dust bin may be defined in the casing 111, and a dust bin cover 112 that opens and closes the opening may be pivotably disposed with respect to the casing 111.

The working means may include a roll-type main brush 184 having bristles exposed via the suction hole **180*h*, and an auxiliary brush 185 located at a front side of the bottom surface of the main body 110 and having bristles composed of multiple radially extending wings. The dust or the foreign substances may be removed from the floor in the travel section by rotation of the brushes 184 and 185, and the dust or the foreign substances removed from the floor as such may be sucked via the suction hole 180*h*** and collected in the dust collecting means.

The robot cleaner 100 may include a corresponding terminal 190 coming into contact with the charging device for the robot cleaner to charge the battery 177 when docked with the charging device for the robot cleaner. The corresponding terminal 190 may be disposed to be accessible to a charging terminal disposed on the charging device for the robot cleaner in a successful docked state of the robot cleaner 100. In one embodiment, a pair of corresponding terminals 190 may be disposed on the bottom surface of the main body 110.

The robot cleaner 100 may include input means 171 for inputting information. The input means 171 may receive an On/Off command or various commands. The input means 171 may include a button, a key, a touch-type display, or the like. The input means 171 may include a microphone for voice recognition.

The robot cleaner 100 may include output means (not shown) for outputting information, communication means (not shown) for transmitting and receiving information with other external devices, and storage (not shown) for storing various types of information.

The robot cleaner 100 may include a controller (not shown) that processes and determines various information such as mapping and/or recognizing a current location. The controller may control overall operations of the robot cleaner 100 via control of various components of the robot cleaner 100.

Figure 2:
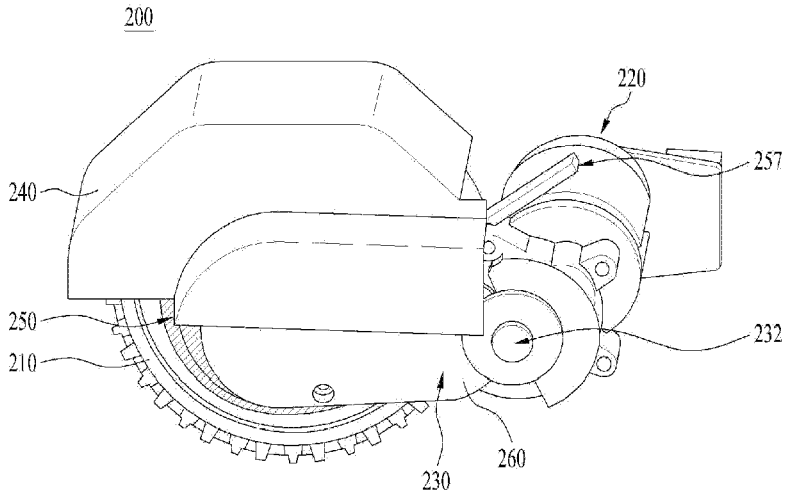
FIGS. 2 to 4 are diagrams for illustrating travel means included in a robot cleaner.
Figure 3:
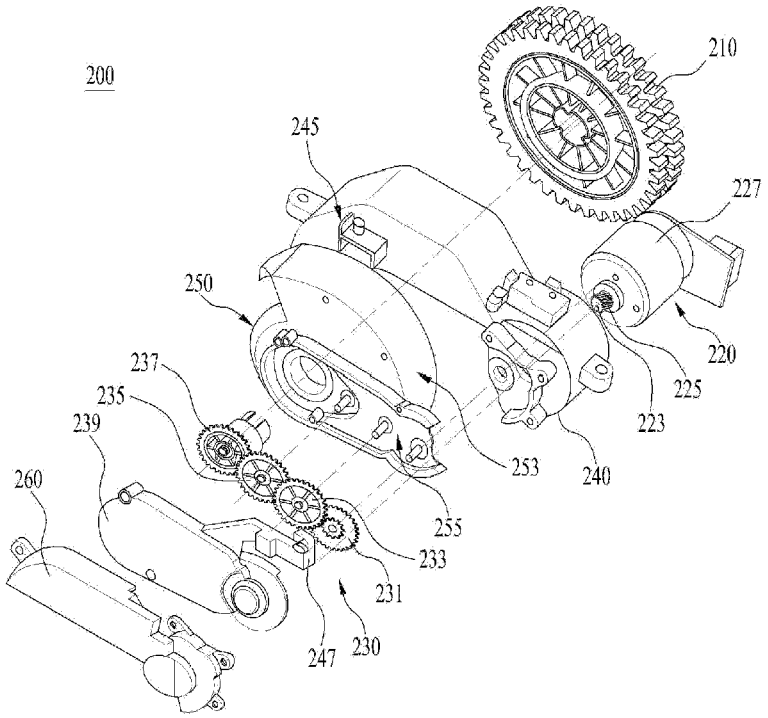
Figure 4:
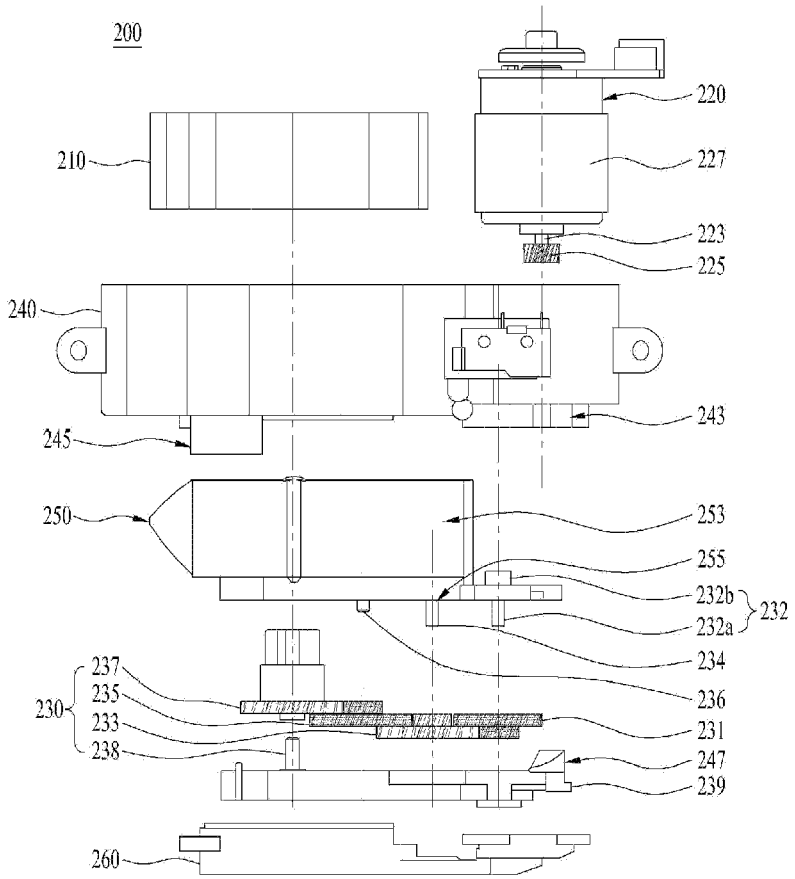

FIGS. 2 to 4 are diagrams for illustrating the travel means included in the robot cleaner. More specifically, FIG. 2 is a perspective view for illustrating an overall outer appearance of travel means, FIG. 3 is an exploded perspective view for illustrating components of travel means, and FIG. 4 is an exploded top view for illustrating components of travel means.

Referring to FIGS. 2 to 4, the travel means 200 included in the robot cleaner 100 according to one embodiment of the present disclosure may include a driving wheel 210 for moving the main body 110, a driving motor 220 for driving the driving wheel 210, a reduction gear assembly 230 for connecting the driving wheel 210 and the driving motor 220 to each other and transferring a rotational force generated from the driving motor 220 to the driving wheel 210, a first housing 240 coupled to the driving motor 220 and covering at least a portion of the driving wheel 210, and a second housing 250. The first housing 240 may be disposed between the driving wheel 210 and the second housing 250 and coupled to the driving wheel 210.

The driving motor 220 may be coupled by being fixed inside the main body 110, and may include a driving shaft 223 and a driving gear 225 for transmitting the rotational force generated from the driving motor. The driving gear 225 may be coupled to one end of the driving shaft 223, and the driving shaft 223 and the driving gear 225 may rotate together.

A wheel accommodating portion 253 for accommodating the driving wheel 210 may be disposed at one side of the second housing 250, and a gear accommodating portion 255 for accommodating the reduction gear assembly 230 may be disposed at the other side opposite to one side of the second housing 250. The second housing 250 may include a stopper 257 that serves as a bump such that pivoting of the second housing 250 is performed within a preset area, and the stopper 257 may be seated on a portion of the first housing 240 adjacent to the driving motor 220.

The driving wheel 210 may be accommodated inside the wheel accommodating portion 253 of the second housing and coupled to the second housing 250, and may rotate by the rotational force transmitted from the driving motor 220.

The first housing 240 may be fixed to the main body 110 by the coupling with the driving motor 220 and may cover the driving wheel 210 and the second housing 250 together.

FIG. 2 shows that the first housing 240 covers only the wheel accommodating portion 253 and the gear accommodating portion 255 of the second housing 250 and does not cover the driving motor 220, but the concept of the present disclosure is not necessarily limited thereto. As shown in FIGS. 3 and 4, the first housing 240 may cover not only the wheel accommodating portion 253 and the gear accommodating portion 255 of the second housing 250, but also the driving motor 220 together. That is, a shape of the first housing 240 is not particularly limited.

In embodiments, the first housing 240 may include a first housing coupling groove (not shown) defined in a portion of an inner circumferential surface thereof, and the driving motor 220 may include a first housing coupled portion 227 protruding from an outer circumferential surface thereof. Rotation of the first housing 240 along an outer circumferential surface of the driving motor 220 may be prevented by coupling of the first housing coupled portion 227 and the first housing coupling groove.

The reduction gear assembly 230 may include a plurality of reduction gears arranged to rotate in mesh with each other, and the plurality of reduction gears may be arranged in the gear accommodating portion 255 of the second housing.

More specifically, the reduction gear assembly 230 may include a first reduction gear 231 disposed to mesh with the driving gear 225, a second reduction gear 233 disposed to mesh with the first reduction gear 231, and a third reduction gear 235 disposed to mesh with the second reduction gear 233.

In addition, the reduction gear assembly 230 may further include a first gear shaft 232 extending through a central portion of the first reduction gear 231, a second gear shaft 234 extending through a central portion of the second reduction gear 233, and a third gear shaft 236 extending through a central portion of the third reduction gear 235.

The first reduction gear 231 to the third reduction gear 235 may be coupled to the gear accommodating portion 255 of the second housing as the first gear shaft 232 to the third gear shaft 236 respectively extend through the respective central portions thereof.

FIGS. 3 and 4 disclose that three reduction gears are included in the reduction gear assembly 230, but the concept of the present disclosure is not necessarily limited thereto. That is, the number of reduction gears included in the reduction gear assembly 230 may be greater or smaller than three.

In embodiments, the second housing 250 may be coupled to the first housing 240 so as to pivot with one of the plurality of gear shafts 232, 234, and 236 as a pivoting shaft, and the driving wheel 210 accommodated in the wheel accommodating portion 253 of the second housing may pivot together with the second housing 250 using one of the plurality of gear shafts 232, 234, and 236 as a pivoting shaft. That is, the second housing 250 and the driving wheel 210 coupled thereto may pivot together using the gear shaft of the reduction gear included in the reduction gear assembly 230 as the pivoting shaft.

In one embodiment, the second housing 250 may be coupled to the first housing 240 so as to pivot using a gear shaft of a reduction gear located closest to the driving motor 220 among the plurality of reduction gears as the pivoting shaft. The driving wheel 210 may pivot together with the second housing 250 using the gear shaft of the reduction gear located closest to the driving motor 220, that is, the first gear shaft 232 of the first reduction gear 231 as the pivoting shaft.

Alternatively, although not shown, the second housing 250 may be coupled to the first housing 240 so as to pivot using a gear shaft of a reduction gear located second closest to the driving motor 220 among the plurality of reduction gears as the pivoting shaft. The driving wheel 210 may pivot together with the second housing 250 using the gear shaft of the reduction gear located second closest to the driving motor 220, that is, the second gear shaft 234 of the second reduction gear 233 as the pivoting shaft, or may pivot using the gear shaft of the reduction gear located third closest to the driving motor 220, that is, the third gear shaft 236 of the third reduction gear 235 as the pivoting shaft.

In other words, the driving wheel 210 may be constructed to pivot together with the second housing 250. In this regard, the pivoting shaft of the driving wheel 210 may not be the driving shaft 223 included in the driving motor 220, but may be one of the plurality of reduction gears included in the reduction gear assembly 230, and the first gear shaft 231, the second gear shaft 233, or the third gear shaft 235, which may serve as the pivoting shaft of the driving wheel 210, may not be disposed coaxially with the driving shaft 223.

In one example, the reduction gear assembly 230 may further include a wheel gear 237 coupled to the driving wheel 210 and a wheel gear shaft 238 extending through a central portion of the wheel gear 237, and the wheel gear 237 and the wheel gear shaft 238 may extend through the gear accommodating portion 230 together and be coupled to a central portion of the driving wheel 210.

The gear accommodating portion 255 may further include a first reduction gear cover 239 that covers the reduction gear assembly 230 so as not to be exposed to the outside. The first gear shaft 232 may extend through the first reduction gear cover 239 and the first reduction gear cover 239 may be coupled to the second housing 250.

The first housing 240 may further include a second reduction gear cover 260 that covers the first gear shaft 232 and a portion of the first reduction gear cover 239 adjacent to the first gear shaft 232 so as not to be exposed to the outside.

A suspension for connecting the first housing 240 and the second housing 250 to each other and allowing the pivoting of the second housing 250 to be elastically performed may be disposed between the first housing 240 and the second housing 250. The suspension may include a first suspension coupling portion 245 and a second suspension coupling portion 255 disposed on the first housing 240, and an elastic member (not shown) coupled to the first suspension coupling portion 245 and the second suspension coupling portion 250 and providing a restoring force such that the second housing 250 returns to a preset location with respect to the first housing 240.

The first suspension coupling portion 245 may be formed to protrude outwards from a portion of the first housing 240 for covering the driving wheel 210, the second suspension coupling portion 247 may be formed to protrude outwards from the second reduction gear cover 260 of the first housing 240, and the first suspension coupling portion 245 and the second suspension coupling portion 247 may be disposed so as to be spaced apart from each other. In one embodiment, the first suspension coupling portion 245 and the second suspension coupling portion 247 may be formed parallel to each other.

The elastic member may be formed of, for example, a spring.

Hereinafter, a method for assembling the travel means 200 included in the robot cleaner 100 according to an embodiment of the present disclosure will be described with reference to FIGS. 5 to 9.

FIGS. 5 to 9 are perspective views for illustrating a method for assembling the travel means 200 included in the robot cleaner 100 according to one embodiment of the present disclosure.

Hereinafter, for convenience of illustration, a portion for covering the wheel accommodating portion 253 and the gear accommodating portion 255 of the second housing 250 among portions of the first housing 240 is omitted, and only a portion of the first housing 240 coupled to the driving motor 220 is shown. Because the portion of the first housing 240 for covering the wheel accommodating portion 253 and the gear accommodating portion 255 of the second housing 250 is substantially the same as or similar to a shape of the first housing 240 illustrated with reference to FIGS. 3 and 4, a detailed description for the same component is omitted.

Figure 5:
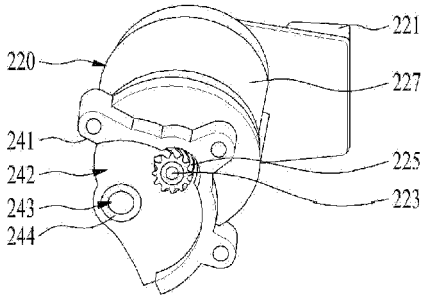
FIGS. 5 to 9 are perspective views for illustrating a method for assembling travel means.

Referring to FIG. 5, one side of the driving motor 220 may be fixed by being coupled to the main body 110 of the robot cleaner 100, and the first housing 240 may be fixed by being coupled to the other side opposite to the one side of the driving motor 220. In this regard, the first housing 240 may be coupled while surrounding the driving motor 220 by sliding from the other side to the one side of the driving motor 220. In this regard, the first housing 240 may be prevented from rotating along the outer circumferential surface of the driving motor 220 as the first housing coupling groove (not shown) disposed on the portion of the inner circumferential surface of the first housing 240 and the first housing coupled portion 227 having the shape protruding from the outer circumferential surface of the driving motor 220 are coupled to each other.

The first housing 240 may include a second housing coupled portion for covering at least a portion of a side surface disposed at the other side of the driving motor 220, and the second housing coupled portion may include a second disposition surface 242 through which the driving shaft 223 extends and on which the driving gear 225 is disposed, and a second partition wall 241 partially surrounding an outer circumferential surface of the second disposition surface 242. The second disposition surface 242 may be a surface partitioned by the second partition wall 241 and on which an extension 252*b* of a first disposition surface, which will be described later, is disposed.

A driving shaft receiving portion (not shown) through which the driving shaft 223 extends may be formed on a portion of the second disposition surface 242, and a first gear shaft receiving portion 243 through which the first gear shaft 232 extends may be formed on another part of the second disposition surface 242.

In this regard, a bearing 244 may be inserted into the first gear shaft receiving portion 243. Accordingly, the second housing 250 may use the first gear shaft 232 as the pivoting shaft, but may not be affected by rotation of the first gear shaft 232 itself. That is, the second housing 250 may pivot using the first gear shaft 232 as the pivoting shaft regardless of the rotation of the first gear shaft 232 itself.

In embodiments, the first gear shaft receiving portion 243 through which the first gear shaft 232 extends may be formed at a location lower than the driving shaft receiving portion through which the driving shaft 223 extends. In one embodiment, a distance between the first gear shaft receiving portion 243 and the driving wheel 210 may be smaller than a distance between the driving shaft receiving portion and the driving wheel 210.

Figure 6:
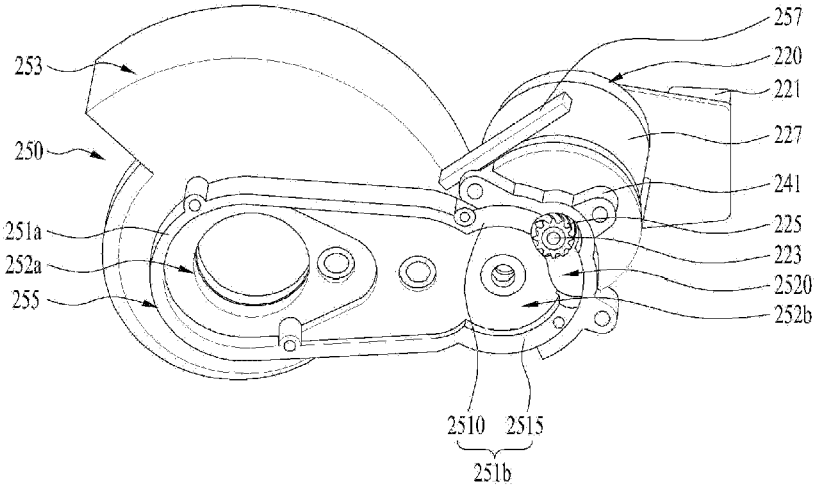
Figure 7:
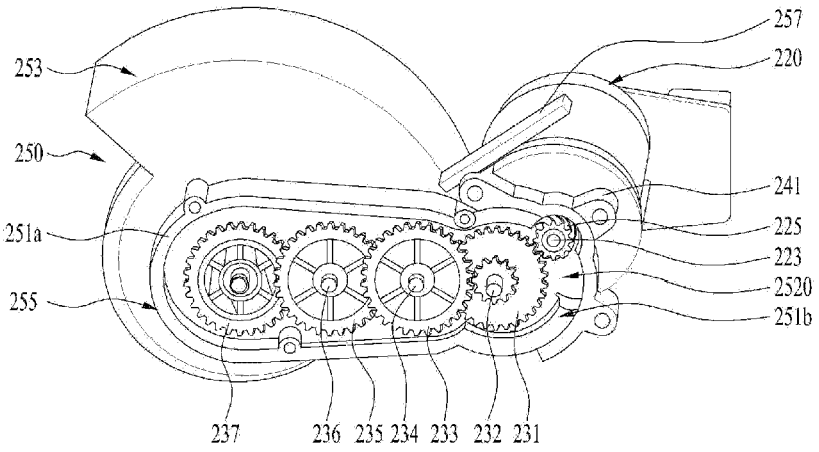

Referring to FIGS. 6 and 7, the second housing 250 may be disposed on the first housing 240, the reduction gear assembly 230 may be disposed in the gear accommodating portion 255 of the second housing 250, and the second housing 250 may be coupled to the first housing 250 so as to pivot using the gear shaft of the reduction gear included in the reduction gear assembly 230 as the pivoting shaft.

The gear accommodating portion 255 of the second housing 250 may include a first partition wall 251*a* protruding from the wheel accommodating portion 253 and a first disposition surface 252*a* partitioned by a first partition wall 251*a* and on which the reduction gear assembly 230 is placed. The first partition wall 251*a* and the first disposition surface 252*a* may respectively have extensions 251*b* and 252*b* extending toward the driving motor 220 more than the wheel accommodating portion 253 and partially overlapping the second housing coupled portion of the first housing 240.

The extension 251*b* of the first partition wall may extend along a circumferential direction of a circle centered on the first gear shaft 232.

The extension 251*b* of the first partition wall may include an upper portion 2510 disposed at a higher location than the first gear shaft 232 in a state before the second housing 250 pivots, and a lower portion 2515 disposed at a lower location than the first gear shaft 232 in the state before the second housing 250 pivots. The upper portion 2510 of the first partition wall extension and the lower portion 2515 of the first partition wall extension may be formed to be spaced apart from each other, and the driving gear 225 may be disposed therebetween.

The extension 251*b* of the first partition wall and the extension 252*b* of the first disposition surface may be disposed to partially overlap the second housing coupled portion of the first housing 240.

The first partition wall 251*a* and the extension 251*b* of the first partition wall may protrude outwards from the second housing 250, and the second partition wall 241 may protrude outwards from the first housing 240. In this regard, the first partition wall 251*a*, the extension 251*b* of the first partition wall, and the second partition wall 241 may protrude in the same direction and have the same height.

The extension 252*b* of the first disposition surface may be disposed on the second disposition surface 242, and the extension 252*b* of the first disposition surface and the second disposition surface 242 may be coupled to each other as the first gear shaft 232 sequentially extends therethrough.

In embodiments, an area of the second disposition surface 242 may be smaller than an area of the first disposition surface extension 252*b*. In one embodiment, a lower portion of the second disposition surface 242 may have a smaller area than an upper portion of the second disposition surface 242. Accordingly, when the second housing 250 pivots, the wheel accommodating portion 253 may be seated on the lower portion of the second disposition surface 242.

In embodiments, the second partition wall 242 may continuously extend so as to cover the upper portion 2510 of the first partition wall extension 251*b* and the lower portion 2515 of the first partition wall extension 251*b* together. Accordingly, in a space surrounded by the second partition wall 242, the upper portion 2510 of the first partition wall extension 251*b*, the lower portion 2515 of the first partition wall extension 251*b*, and the extension 252*b* of the first disposition surface, a driving gear movement portion 2520 in which the driving gear 255 slides when the second housing 250 pivots may be defined. In one embodiment, the driving gear movement portion 2520 may extend along the circumferential direction of the circle centered on the first gear shaft 232 by an angle equal to or greater than a pivoting angle of the second housing 250.

The driving gear 225 may be disposed at a different location within the driving gear movement portion 2520 when the second housing 250 pivots. That is, when the second housing 250 pivots, the driving gear movement portion 2520 also pivots together with the second housing 250, but the location of the driving gear 225 is fixed, so that the location of the driving gear 225 within the driving gear movement portion 2520 may be relatively changed.

In one embodiment, the driving gear 225 may be disposed adjacent to the upper portion 2510 of the first partition wall extension 251*b* than to the lower portion 2515 of the first partition wall extension 251*b* within the driving gear movement portion 2520 in the state before the second housing 250 pivots. In contrast, in a state after the second housing 250 pivots, the driving gear 225 may be disposed adjacent to the lower portion 2515 of the first partition wall extension 251*b* than to the upper portion 2510 of the first partition wall extension 251*b* within the driving gear movement portion 2520.

The reduction gear assembly 230 may include the first reduction gear 231 disposed to mesh with the driving gear 225, the second reduction gear 233 disposed to mesh with the first reduction gear 231, the third reduction gear 235 disposed to mesh with the second reduction gear 233, and the wheel gear 237 disposed to mesh with the third reduction gear 235 and coupled to the driving wheel 210, and may further include the first gear shaft 232 extending through the central portion of the first reduction gear 231, the second gear shaft 234 extending through the central portion of the second reduction gear 233, and the third gear shaft 236 extending through the central portion of the third reduction gear 235. The first to third reduction gears 231, 233, and 235 may be coupled to the gear accommodating portion 255 of the second housing 250 as the first to third gear shafts 232, 234, and 236 respectively extend therethrough.

The first reduction gear 231 may be disposed on the extension 252*b* of the first disposition surface, and the first gear shaft 232 may extend through the first reduction gear 231 and be coupled to the second housing 250. In this regard, the first gear shaft 232 may also extend through the first gear shaft receiving portion 243 and the bearing 244 formed in the second housing coupled portion of the first housing 240, and thus the first gear shaft 232 may also be coupled to the first housing 240. Accordingly, the second housing 250 may be coupled to the first housing 240 via the first gear shaft 232.

In embodiments, the first gear shaft 232 may be composed of a first portion 232*a* extending through the first reduction gear 231 and the second housing 250 and a second portion 232*b* extending through the first gear shaft receiving portion 243 and the bearing 244. A diameter of the first portion 232*a* of the first gear shaft and a diameter of the second portion 232*b* of the first gear shaft may have different sizes. That is, for example, as shown in FIG. 4, the second portion 232*b* of the first gear shaft may have a larger diameter than the first portion 232*a* of the first gear shaft. In one embodiment, a bushing for facilitating the pivoting of the second housing 250 may be further formed on a surface of the second portion 232*b* of the first gear shaft.

In embodiments, the first gear shaft receiving portion 243 through which the first gear shaft 232 extends may be formed at a location lower than the driving shaft receiving portion through which the driving shaft 223 extends. In one embodiment, the distance between the first gear shaft receiving portion 243 and the driving wheel 210 may be smaller than the distance between the driving shaft receiving portion and the driving wheel 210.

The second reduction gear 233, the third reduction gear 235, and the wheel gear 237 may be placed on the first disposition surface 252*a*, and the second gear shaft 234 and the third gear shaft 236 may be coupled to the second housing 250 by extending through the second reduction gear 233 and the third reduction gear 235, respectively. In this regard, unlike the first gear shaft 232 that is not only coupled to the second housing 250 by extending through the extension 252*b* of the first disposition surface but also coupled to the first housing 240 by extending through the first gear shaft receiving portion 243 of the second disposition surface 242, the second gear shaft 234 and the third gear shaft 236 may be coupled only to the second housing 250 by completely or partially extending through only the extension 252*b* of the first disposition surface. In one example, the wheel gear shaft 238 disposed on a first reduction gear cover 239 to be described later may extend through the wheel gear 237, and thus, the wheel gear 237 and the wheel gear shaft 238 may extend through the gear accommodating portion 230 and be coupled to the central portion of the driving wheel 210 together.

Figure 8:
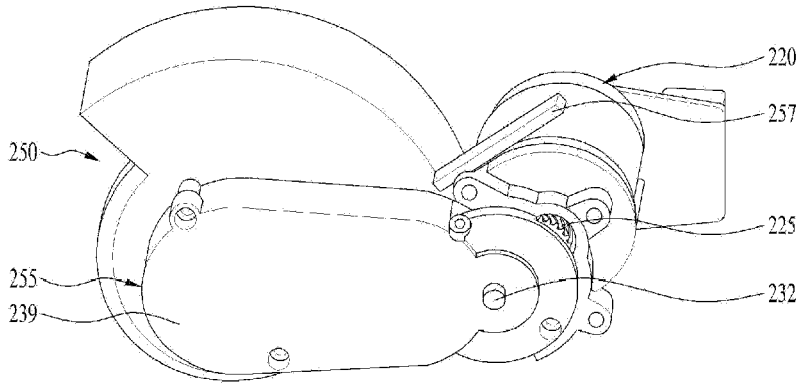
Figure 9:
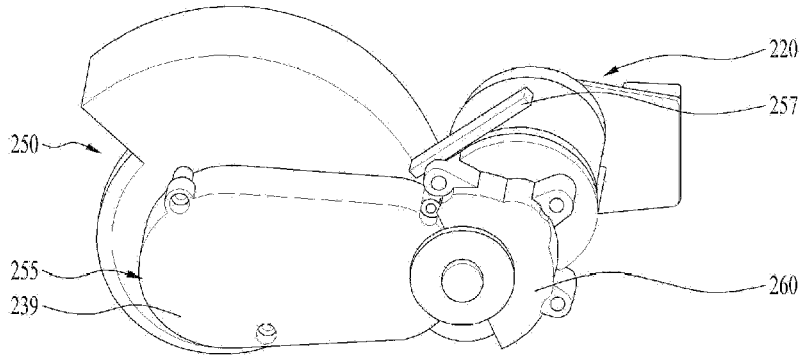

Referring to FIGS. 8 and 9, after coupling the first reduction gear cover 239 for covering the reduction gear assembly 230 to the gear accommodating portion 255 of the second housing 250, the second reduction gear cover 260, which covers the portion adjacent to the first gear shaft 232 of the first reduction gear cover 239 so as not to be exposed to the outside, may be coupled to the first housing 240.

The first reduction gear cover 239 may be coupled to the second housing 250 as the first gear shaft 232 extends therethrough, and may pivot using the first gear shaft 232 as the pivoting shaft. The first reduction gear cover 239 may be further coupled to the second housing 250 via additional coupling members in addition to the first gear shaft 232. In this regard, the first gear shaft 232 may extends through the first reduction gear cover 239 and be exposed to the outside.

The second reduction gear cover 260 may be disposed to cover the first reduction gear cover 239 and the first gear shaft 232 together, and may be fixed by being coupled to the first housing 240 via separately prepared coupling members. Therefore, the pivoting of the second housing 250 may be supported on both sides by the second housing coupled portion of the first housing 240 and the second reduction gear cover 260.

Thereafter, by coupling the driving wheel 210 to the wheel accommodating portion 253 of the second housing 250, the method for assembling the travel means 200 of the robot cleaner 100 according to one embodiment of the present disclosure may be completed.

Figure 10:
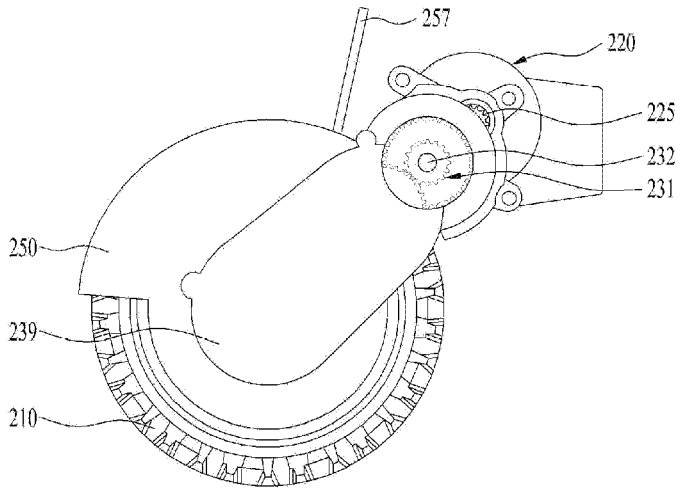
FIG. 10 is a side view for illustrating pivoting of a driving wheel included in a robot cleaner according to one embodiment of the present disclosure.
Figure 10:
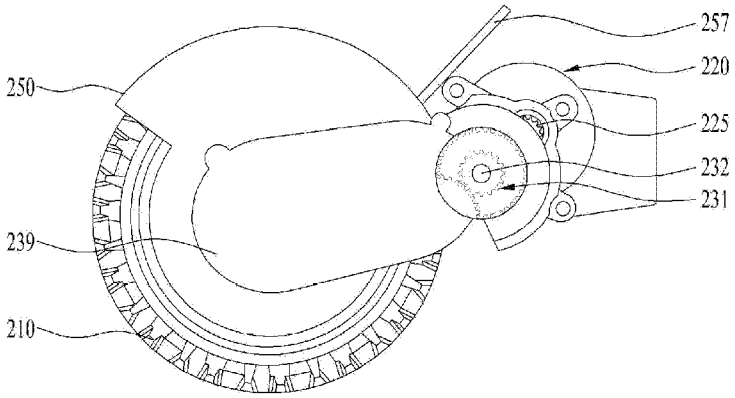

FIG. 10 is a side view for illustrating the pivoting of the driving wheel 210 included in the robot cleaner 100 according to one embodiment of the present disclosure. More specifically, (a) in FIG. 10 is a side view for illustrating a state after the driving wheel 210 pivots together with the second housing 250 using the first gear shaft 232 of the first reduction gear 231 as the pivoting shaft, and (b) in FIG. 10 is a side view for illustrating a state before the driving wheel 210 pivots together with the second housing 250 using the first gear shaft 232 of the first reduction gear 231 as the pivoting shaft.

Referring to FIG. 10, the driving wheel 210 included in the robot cleaner 100 according to one embodiment of the present disclosure may pivot using the gear shafts 232, 234, and 236 of the reduction gears 231, 233, and 235 included in the reduction gear assembly 230 as the pivoting shaft when suspension is performed.

In one embodiment, the driving wheel 210 may pivot using the gear shaft of the reduction gear located closest to the driving motor, that is, the first gear shaft 232 of the first reduction gear 231 as the pivoting shaft.

As described above, according to the robot cleaner 100 according to embodiments of the present disclosure, when the driving wheel 210 pivots, the driving motor 220 connected to the driving wheel 210 via the plurality of reduction gears 231, 233, and 235 may be fixed so as not to pivot together. Accordingly, disconnection of wires connected to the driving motor 220 may be prevented.

In this regard, the driving wheel 210 may pivot using the gear shaft 232 of the reduction gear 231 located closest to the driving motor 220 among the plurality of reduction gears 231, 233, and 235 as the pivoting shaft. In this case, compared to a case in which the driving wheel 210 pivots using the driving shaft 223 of the driving motor 220 as the pivoting shaft, a vertical level of a central shaft of the driving wheel 210 may be relatively high and a vertical reaction force of the driving wheel 210 may increase, and thus the suspension of the driving wheel 210 may be effectively performed.

In addition, when the driving wheel 210 pivots using the gear shaft 232 of the reduction gear 231 located closest to the driving motor 220 as the pivoting shaft, compared to the case in which the driving wheel 210 pivots using the driving shaft 223 of the driving motor 220 as the pivoting shaft, a distance between the central shaft of the driving wheel 210 and the pivoting shaft of the driving wheel 210 may decrease, and accordingly, a space required for the suspension of the driving wheel 210 may decrease.

Although various embodiments of the present disclosure have been described in detail above, those with ordinary skill in the technical field to which the present disclosure belongs will understand that various modifications are possible with respect to the above-described embodiments without departing from the scope of the present disclosure. Therefore, the scope of rights of the present disclosure should not be limited to the described embodiments and should be defined by the claims to be described later as well as equivalents thereof.

What is claimed is:

1. A robot cleaner comprising:

a main body for forming an outer appearance of the robot cleaner;

a suction portion disposed in the main body;

a dust collecting portion disposed in the main body so as to collect dust introduced via the suction portion;

a driving motor for providing a rotational force including a driving shaft and a driving gear coupled to one end of the driving shaft;

a driving wheel rotating by driving the driving motor;

a reduction gear assembly for connecting the driving motor and the driving wheel to each other and transmitting the rotational force generated from the driving motor to the driving wheel;

a first housing coupled to the driving motor and covering at least a portion of the driving wheel; and a second housing coupled to the driving wheel and the first housing, wherein the second housing has a wheel accommodating portion for accommodating therein the driving wheel at a first side thereof, and a gear accommodating portion for accommodating therein the reduction gear assembly at a second side thereof, wherein the first housing is fixed by the coupling with the driving motor, wherein the second housing and the driving wheel coupled thereto are constructed to pivot together using a gear shaft of a reduction gear included in the reduction gear assembly as a pivoting shaft, and wherein the driving shaft is parallel with the pivoting shaft.

2. The robot cleaner of claim 1, wherein the reduction gear assembly includes a plurality of reduction gears disposed in the gear accommodating portion so as to be engaged with each other and a plurality of gear shafts extending through respective central portions of the plurality of reduction gears, wherein the plurality of reduction gears are coupled to the gear accommodating portion by the plurality of gear shafts, respectively, wherein the second housing is coupled to the first housing so as to pivot using one of the plurality of gear shafts as the pivoting shaft, and wherein the driving wheel is constructed to pivot together with the second housing using one of the plurality of gear shafts as the pivoting shaft.

3. The robot cleaner of claim 2, wherein the second housing is coupled to the first housing so as to pivot using a gear shaft of a reduction gear located closest to the driving motor among the plurality of reduction gears as the pivoting shaft, and wherein the driving wheel is constructed to pivot together with the second housing using the gear shaft of the reduction gear located closest to the driving motor as the pivoting shaft.

4. The robot cleaner of claim 2, wherein the reduction gear assembly includes a first reduction gear constructed to be engaged with the driving gear, a second reduction gear constructed to be engaged with the first reduction gear, and a third reduction gear constructed to be engaged with the second reduction gear, and wherein the driving wheel is constructed to pivot together with the second housing using a gear shaft of the first reduction gear as the pivoting shaft.

5. The robot cleaner of claim 4, wherein the reduction gear assembly further includes a first gear shaft extending through a central portion of the first reduction gear, a second gear shaft extending through a central portion of the second reduction gear, and a third gear shaft extending through a central portion of the third reduction gear, and wherein the driving wheel is constructed to pivot together with the second housing using the first gear shaft as the pivoting shaft.

6. The robot cleaner of claim 5, wherein the first gear shaft serving as the pivoting shaft of the driving wheel is not disposed coaxially with the driving shaft.

7. The robot cleaner of claim 5, wherein the gear accommodating portion includes a first partition wall protruding from the wheel accommodating portion and a first disposition surface partitioned by the first partition wall such that the reduction gear assembly is disposed thereon, and wherein the first partition wall and the first disposition surface respectively have extensions extending toward the driving motor more than the wheel accommodating portion and partially overlapping the first housing.

8. The robot cleaner of claim 7, wherein the extension of the first partition wall extends along a circumferential direction of a circle centered on the first gear shaft.

9. The robot cleaner of claim 8, wherein the extension of the first partition wall includes an upper portion disposed at a higher location than the first gear shaft in a state before the second housing pivots, and a lower portion disposed at a lower location than the first gear shaft in the state before the second housing pivots, and wherein the upper portion of the extension of the first partition wall and the lower portion of the extension of the first partition wall are formed to be spaced apart from each other, and the driving gear is disposed therebetween.

10. The robot cleaner of claim 9, wherein the first housing includes a second housing coupled portion partially overlapping the extension of the first partition wall and the extension of the first disposition surface, wherein the second housing coupled portion includes a second partition wall protruding in the same direction as a protruding direction of the first partition wall from the first housing, and a second disposition surface partitioned by the second partition wall such that the extension of the first disposition surface is disposed thereon, and wherein the extension of the first disposition surface and the second disposition surface are coupled to each other as the first gear shaft sequentially extends therethrough.

11. The robot cleaner of claim 10, wherein an area of the second disposition surface is smaller than an area of the extension of the first disposition surface.

12. The robot cleaner of claim 10, wherein the second partition wall continuously extends so as to cover the upper portion of the extension of the first partition wall and the lower portion of the extension of the first partition wall together, and wherein, in a space surrounded by the second partition wall, the upper portion of the extension of the first partition wall, the lower portion of the extension of the first partition wall, and the extension of the first disposition surface, a driving gear movement portion where the driving gear slides when the second housing pivots is defined.

13. The robot cleaner of claim 12, wherein the driving gear movement portion extends along the circumferential direction of the circle centered on the first gear shaft by an angle equal to or greater than a pivoting angle of the second housing, and wherein the driving gear is disposed at a different location within the driving gear movement portion when the second housing pivots.

14. The robot cleaner of claim 13, wherein the driving gear is disposed adjacent to the upper portion of the extension of the first partition wall than to the lower portion of the extension of the first partition wall within the driving gear movement portion in the state before the second housing pivots, and wherein, in a state after the second housing pivots, the driving gear is disposed adjacent to the lower portion of the extension of the first partition wall than to the upper portion of the extension of the first partition wall within the driving gear movement portion.

15. The robot cleaner of claim 2, wherein the reduction gear assembly further includes a wheel gear coupled to the driving wheel and a wheel gear shaft extending through a central portion of the wheel gear, and wherein the wheel gear and the wheel gear shaft extend through the gear accommodating portion together and are coupled to a central portion of the driving wheel.

16. The robot cleaner of claim 2, wherein the gear accommodating portion further includes a first reduction gear cover for covering the reduction gear assembly so as not to be exposed to an outside, and wherein a first gear shaft extends through the first reduction gear cover and the first reduction gear cover is constructed to pivot using the first gear shaft as a pivoting shaft.

17. The robot cleaner of claim 16, wherein the first housing includes a second reduction gear cover for covering the first gear shaft and a portion of the first reduction gear cover adjacent to the first gear shaft so as not to be exposed to the outside.

18. The robot cleaner of claim 17, further comprising a suspension for connecting the first housing and the second housing to each other and allowing the pivoting of the second housing to be elastically performed.

19. The robot cleaner of claim 18, wherein the suspension includes a first suspension coupling portion and a second suspension coupling portion disposed on the first housing, and an elastic portion coupled to the first suspension coupling portion and the second suspension coupling portion.

20. A robot cleaner comprising:

a driving motor disposed in a main body and including a driving shaft and a driving gear coupled to one end of the driving shaft;

a driving wheel rotating by driving the driving motor;

a reduction gear assembly for connecting the driving motor and the driving wheel to each other and transmitting a rotational force generated from the driving motor to the driving wheel;

a first housing coupled to the driving motor and covering at least a portion of the driving wheel; and a second housing coupled to the driving wheel and the first housing, wherein the second housing has a wheel accommodating portion for accommodating therein the driving wheel at a first side thereof, and a gear accommodating portion for accommodating therein the reduction gear assembly at a second side thereof, wherein the first housing is fixed by the coupling with the driving motor, and wherein the second housing and the driving wheel coupled thereto are constructed to pivot together using a gear shaft of a reduction gear located second closest to the driving motor among reduction gears included in the reduction gear assembly as a pivoting shaft.

* * * * *